US008458867B2

(12) United States Patent
Rogers et al.

(10) Patent No.: US 8,458,867 B2
(45) Date of Patent: Jun. 11, 2013

(54) ATTACHMENT MOUNT AND RECEIVER SYSTEM FOR REMOVABLY ATTACHING ARTICLES TO GARMENTS

(76) Inventors: William H. Rogers, St. Augustine, FL (US); Matthew E. McKendrick, Jacksonville, FL (US)

( * ) Notice: Subject to any disclaimer, the term of this patent is extended or adjusted under 35 U.S.C. 154(b) by 1070 days.

(21) Appl. No.: 12/316,554

(22) Filed: Dec. 12, 2008

(65) Prior Publication Data

US 2009/0277936 A1 Nov. 12, 2009

Related U.S. Application Data

(60) Provisional application No. 61/127,125, filed on May 10, 2008.

(51) Int. Cl.
*A41F 1/00* (2006.01)

(52) U.S. Cl.
USPC ..... 24/614; 24/3.12; 24/457

(58) Field of Classification Search
USPC ..... 24/614, 615, 625, 629, 3.12, 457
See application file for complete search history.

(56) References Cited

U.S. PATENT DOCUMENTS

| | | | | |
|---|---|---|---|---|
| 4,945,614 | A * | 8/1990 | Kasai | 24/579.09 |
| 7,096,545 | B2 * | 8/2006 | Uehara et al. | 24/614 |
| 2001/0032379 | A1 * | 10/2001 | Chang | 24/614 |
| 2003/0074772 | A1 * | 4/2003 | Chen | 24/614 |
| 2006/0090310 | A1 * | 5/2006 | Uehara et al. | 24/614 |
| 2007/0186394 | A1 * | 8/2007 | Hsiao | 24/614 |
| 2011/0271499 | A1 * | 11/2011 | Parisi | 24/615 |

* cited by examiner

*Primary Examiner* — Victor Batson
*Assistant Examiner* — Matthew Sullivan
(74) *Attorney, Agent, or Firm* — Arthur G. Yeager

(57) ABSTRACT

An attachment mount and receiver system for attaching articles to a garment. A receiver has openings for affixing the receiver to a support that is then attached to a compatible garment. The mount has openings for affixing an article thereto. A pair of flexible springs permit connected tines to be compressed inwardly, allowing the mount to be slidingly inserted into the receiver. A barb at the end of each tine engages an end wall of the receiver when the mount is fully seated. Tines are compressed inwardly and the mount is withdrawable. Selective locks can inhibit the tines from being compressed. Resistance to prying the mount away from the receiver is also provided.

22 Claims, 15 Drawing Sheets

ATTACHMENT MOUNT AND RECEIVER SYSTEM FOR REMOVABLY ATTACHING ARTICLES TO GARMENTS

CROSS-REFERENCE TO RELATED APPLICATION

The present application is a continuation in part of my U.S. Provisional Patent Application No. 61/127,125, filed May 10, 2008, entitled Multi-Mount Systems for Accessories Attachable to Garments. This application is incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

This invention relates generally to connectors, fasteners, and attaching systems to secure articles to a garment or the like, and more particularly to an attachment mount and receiver that are used to secure holsters, pouches, or other modular accessories to a MOLLE/PALS compliant garment, to a similarly designed garment, or to a non-compliant garment such as a harness, waist belt, leg belt, or leg support, by attaching the receiver to the garment and by permitting the attachment mount to be securely locked within the receiver while also permitting the attachment mount to be released again and removed from the receiver.

2. Relevant Art

MOLLE is an acronym for MOdular Lightweight Load-carrying Equipment. It is used to define the current generation of load-bearing equipment and rucksacks utilized by the United States Army. The modularity of the system is derived from the use of Pouch Attachment Ladder System or PALS webbing, rows of heavy-duty nylon precisely stitched onto the vest as to allow for attachment of various MOLLE-compatible pouches and accessories. This method of attachment has become somewhat of a standard for all quality modular military gear, replacing the click and stick system used in the earliest modular vest systems (which is still in use with most Western police departments). It is produced for the United States Government under contract by several contractors. See for example, U.S. Pat. No. 5,724,707.

PALS is a grid of webbing invented and patented by United States Army Natick Soldier Research, Development and Engineering Center used to attach smaller equipment onto load-bearing platforms, such as vests and backpacks. It was first used on MOLLE rucksacks, but is now found on a variety of American equipment, such as the Improved Outer Tactical Vest, Interceptor body armor, USMC Improved Load Bearing Equipment backpack and Modular Tactical Vest. It is used to readily attach items such as holsters, magazine pouches, radio pouches, knife sheaths, and other gear. A wide variety of pouches are commercially available, allowing soldiers to customize their kit. There are also a variety of attachment methods, including the Malice Clip, the Natick snap, and soft, interwoven straps. See for example, U.S. Pat. Nos. 7,080,430; 7,200,871; and 7,240,404. The PALS system has begun to be adopted by other forces, such as the British Army, who use it on their Osprey body armor.

The PALS grid consists of horizontal rows of 1" Mil-W-43668 Type III nylon webbing (most commercial vendors use Type IIIa), spaced 1" apart, and reattached by reinforced stitches or seams to the backing at 1.5" intervals.

There have been numerous designs developed allowing a user to securely attach an article to the MOLLE/PALS system. It can take considerable time to secure and remove an article using these designs. Most of the new designs use additional parts to interlock to the PALS system, while older products use lacing fabric straps. These designs are secure but in many cases are unstable, allowing for a great deal of movement. For articles such as hydration bags or radio pouches, movement is usually not a detriment. However, attachment of a pistol holster for quick deployment of the pistol can be a different matter.

The holster should be on a stable mount so that the user can quickly get a proper grip on the pistol and release the pistol from the holster. There is also a need to be able to quickly remove the holster from the PALS system without first removing the garment from the user's body and then to place the holster on some other part of a garment on the body. While users are traveling in vehicles, it can be advantageous to wear the pistol on the front of the vest but once deployed and on foot, the user might prefer the pistol be mounted at the waist or the leg. Present attachment designs require the removal of the garment in order to remove the article.

BRIEF SUMMARY OF THE INVENTION

The present invention provides an attachment mount and a receiver designed to allow the user to quickly attach an article, such as a holster, a knife, a magazine, or the like, either to a MOLLE/PALS compliant garment, to a similarly designed garment, or to a non-compliant garment such as a waist belt, a shoulder harness, or a leg belt, and to quickly detach the article from same. The attachment mount and receiver are also designed to deter the unwarranted removal of attached articles from a wearer's person. This is accomplished by discouraging easy access by unauthorized persons to an article attached to the attachment mount when the attachment mount is installed within the receiver. For example, preventing a criminal from snatching a firearm from off of a police officer's belt.

Generally, an article is secured to a freed attachment mount before the attachment mount is inserted into a receiver. A receiver, meanwhile, is attached to a garment. Once the article is secured, the attachment mount is inserted into the receiver, thereby securing the article to the garment. Attaching the receiver to a garment is primarily performed in one of two ways. First, the receiver is secured to a support and the support is attached to a non-MOLLES/PALS compliant garment, like a waist belt or leg belt. Second, the receiver is attached to another type of support called a platform, such as described in U.S. Provisional Patent Application No. 61/007,857 ("Provisional '857") to McKendrick and Rogers, entitled PALS Universal Mounting Platform, which provisional patent application is incorporated herein by this reference. The platform is then secured either to a MOLLE/PALS compliant garment or to a similarly designed garment. For example, the receiver can be mounted to a MOLLE/PALS compliant vest. Note that it may also be possible to attach a support to a garment first and then to attach the receiver to the support.

Having an article, such as a pistol holster, affixed to an attachment mount allows for quickly moving the article from place to place about the user. An attachment mount, with its affixed article, can be quickly inserted into a receiver attached to the garment of the user. It can also be quickly withdrawn from the receiver. When additional receivers are mounted on the user, such as on the waist belt or leg belt, the presence of multiple receivers allows the user to quickly move the attachment mount and its affixed article from one receiver to another. For example, the attachment mount and article can be moved quickly from a receiver on the vest of a user to a receiver on the waist belt. A magazine pouch or some other article can then be mounted into the receiver on the vest where the holster was just removed. In this way, one can quickly organize the vest and belt for a specific mission.

The receiver is constructed to resist deformation. For example, a police officer can be equipped with a firearm and holster, with the holster secured to the attachment mount and the attachment mount inserted in a receiver mounted on a support attached to a belt or the like. A person then seeking to snatch the firearm from the officer's holster would be deterred by the receiver's propensity to resist deformation, resulting in the attachment mount remaining secured within the receiver. Furthermore, other means are provided to ensure that the attachment mount is not unduly released from the receiver. For example, embodiments of the invention provide a locking means between the attachment mount and the receiver to positively lock the two components together until release thereof. Upon release, the attachment mount can be slid upwardly and removed from the receiver. An additional safeguard inhibits the prying of the attachment mount away from the receiver by positively intermeshing the top portion of the attachment mount with the top portion of the receiver. Again, upon release thereof, the attachment mount can be slid upwardly and removed from the receiver.

Another feature of the present invention allows a user to mount the receiver to a MOLLE/PALS compliant garment, or to a similarly designed garment, using a support that permits the receiver to be adjusted to a necessary or desired angle. A platform, such as described in U.S. Provisional Patent Application No. 61/127,125 ("Provisional '125"), most particularly relative to FIGS. 16 and 17 therein, is one type of support that can be used with the present invention in this manner. The receiver is equipped to be rotated to engage the platform, or other compatible support, at a desired angle and then to be secured to the platform in that attitude.

BRIEF DESCRIPTION OF THE SEVERAL VIEWS OF THE DRAWING

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE PRESENT INVENTION

Figure 2:
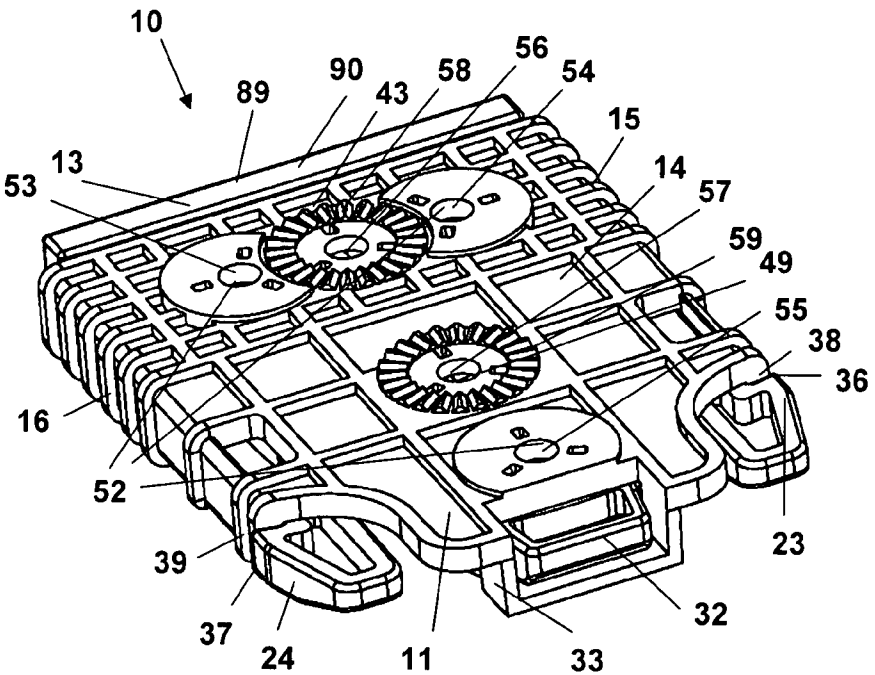
FIG. 2 is a rear perspective view of FIG. 1.

Embodying the principles of the present invention is an attachment mount and receiver system, a preferred embodiment of which is depicted in FIGS. 1-12 and designated generally by reference numeral 10. The attachment mount and receiver system 10 includes an outer receiver 11 and an attachment mount 13. The receiver 11 is configured to slidingly receive the attachment mount 13, whereupon the receiver 11 and the attachment mount 13 are releasably engaged so as to resist the attachment mount 13 being pried outwardly away from the receiver 11, as will be explained more fully herebelow.

Figure 1:
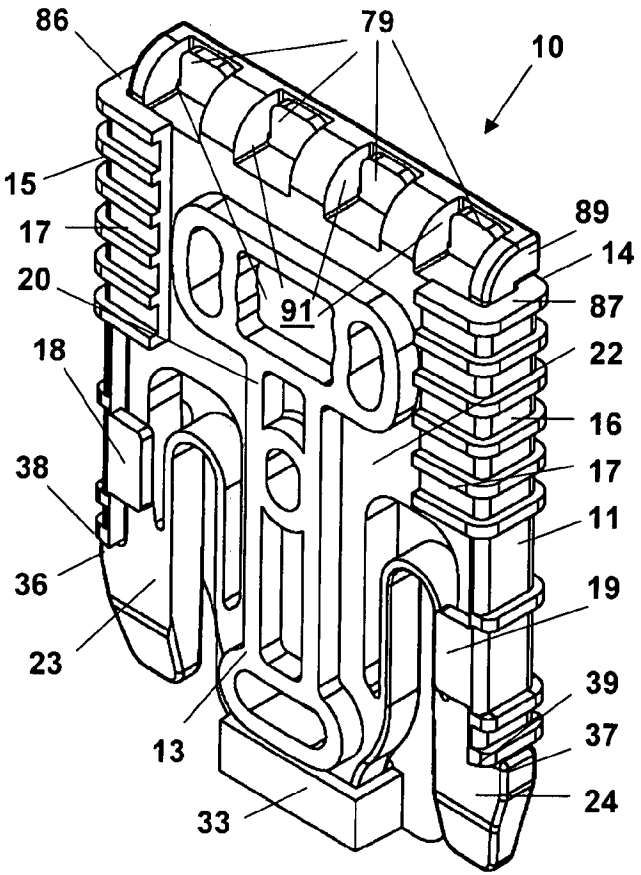
FIG. 1 is a front perspective view of one embodiment of an attachment mount inserted into a receiver, in accord with the present invention.
Figure 3:
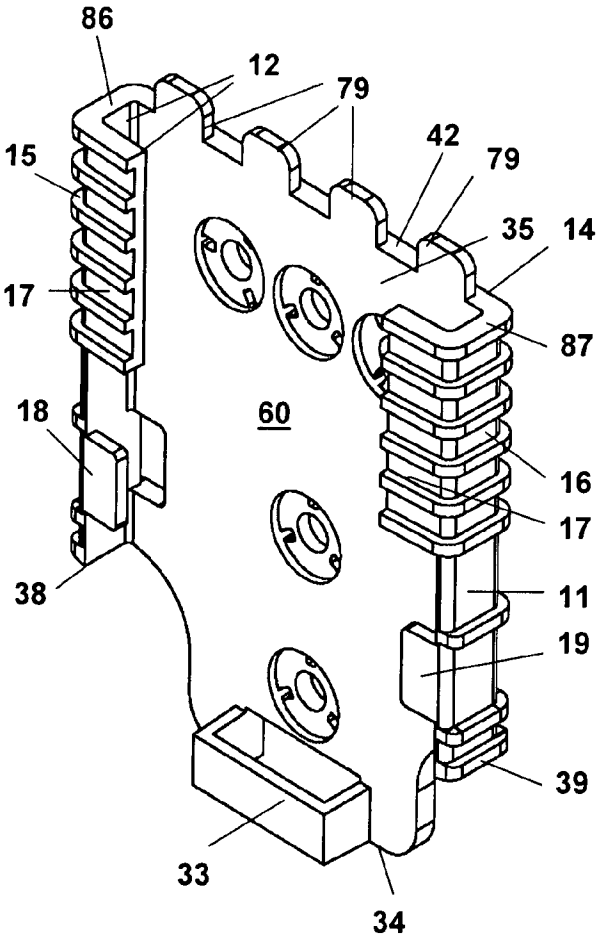
FIG. 3 is a front perspective view of the receiver of FIG. 1 with the attachment mount withdrawn therefrom.

Referring to FIGS. 1 and 3, the receiver 11 comprises a pocket 12 (see FIG. 3) that is bounded by a rear wall 14 with a top end 42 (see FIG. 3) and an inner surface 60 (see FIG. 3); a pair of spaced opposing end walls 15, 16, each with a lower end 38, 39 and a top end 86, 87; a partial front wall 17; and a pair of spaced opposing alignment flanges 18, 19. The pocket 12 has an open top 35 (see FIG. 3) through which the attachment mount 13 (see FIG. 1) is received. The partial front wall 17 assists in maintaining the attachment mount 13 within the receiver 11. The alignment flanges 18, 19 are located between the partial front wall 17 and the lower ends 38, 39 of the end walls 15, 16, with one of the alignment flanges 18, 19 adjacent each opposing end wall 15, 16. The alignment flanges 18, 19 help align the attachment mount 13 as it is being slidingly inserted into or slidingly withdrawn from the receiver 11, so as to keep the attachment mount 13 within the pocket 12 of the receiver 11 as the attachment mount 13 is being inserted or withdrawn.

Figure 4:
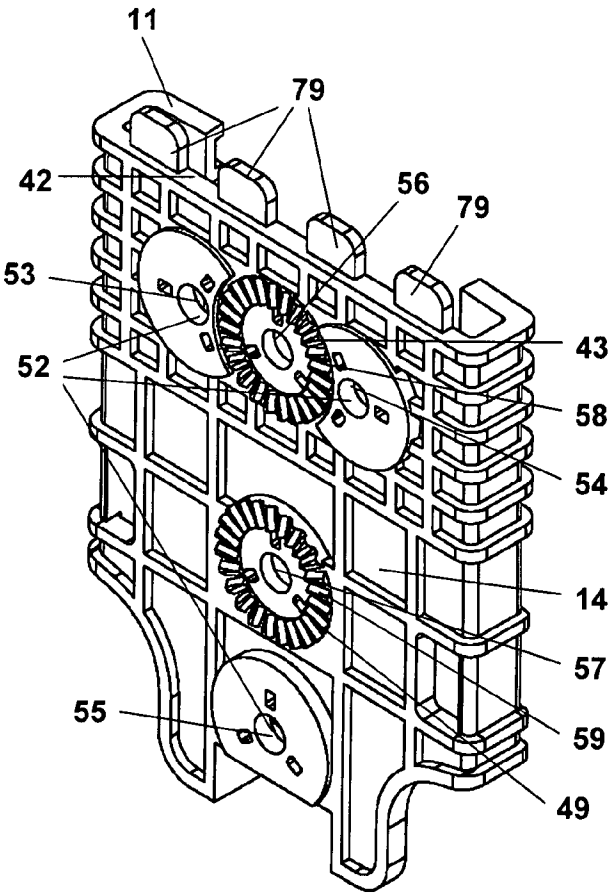
FIG. 4 is a rear perspective view of FIG. 3.

Referring now to FIGS. 2 and 4, the rear wall 14 of the receiver 11 includes a hole pattern 52 that has two horizontally spaced holes 53, 54 and a vertically spaced hole 55, common in the art. One or more connectors (not shown) can be passed through these holes 53, 54, 55 to attach the receiver 11 to a support (not shown). As understood in the art, if two or more of the holes 53, 54, 55 of the hole pattern 52 are used to attach the receiver 11 to a support, then the receiver 11 will be in a locked position on the support. One such type of support to which the receiver 11 can be attached is a platform as described in Provisional '857. Such a platform can be releasably attached to webbing of a MOLLE/PALS compliant garment or to a similarly designed garment, as also described in Provisional '857.

Continuing with FIGS. 2 and 4, the rear wall 14 of the receiver 11 also includes a pair of spaced spline arrangements 43, 49, an upper spline arrangement 43 and a lower spline arrangement 49, that are molded to an outside surface of the rear wall 14. The upper spline arrangement 43 includes a locking spline 58 surrounding an attaching hole 56. The locking spline 58 can engage a compatible spline of a support (not shown) and a connector (not shown) can be passed through the attaching hole 56 to attach the receiver 11 to the support. Likewise, the lower spline arrangement 49 also includes a locking spline 59 surrounding an attaching hole 57. This locking spline 59 also can engage a compatible spline of a support and the attaching hole 57 can be used to attach the receiver 11 to the support. In addition, if a support has a spline that is compatible with both locking splines 58, 59, then either of the locking splines 58, 59 can engage the spline of the support to dispose the receiver 11 in a number of angled positions. The angular relationship between the receiver 11 and the support will be in increments of approximately 15°. Of course, if the support includes two compatible splines and both splines are affixed to both locking splines 58, 59 of the receiver 11, then the angled positions that the receiver 11 can assume will be limited likely to only two positions, one position approximately 180° relative to the other position.

Figure 17:
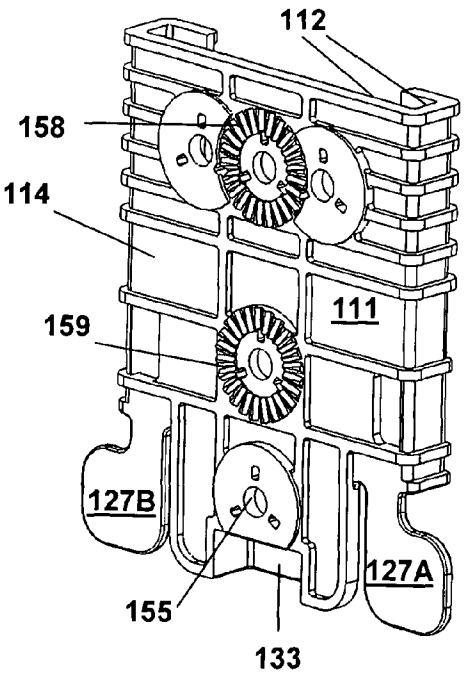
FIG. 17 is a rear perspective view of FIG. 15.
Figure 16:
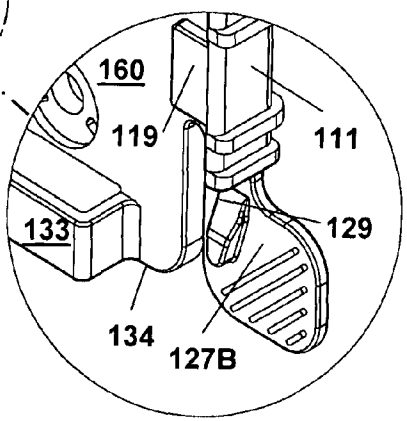
FIG. 16 is an enlarged partial view of FIG. 15.

Regarding FIGS. 2 and 4, one type of support to which the receiver 11 can be attached is a platform as described in Provisional '125 and as shown in FIGS. 16 and 17 of that application. Such a platform contains a spline compatible with the locking splines 58, 59 of the receiver 11. Both the hole pattern 52 and the upper and lower spline arrangements 43, 49 of the receiver 11 provide a number of different attachment possibilities that permit the receiver 11 to be attached to many differently-configured supports and the like.

Figure 9:
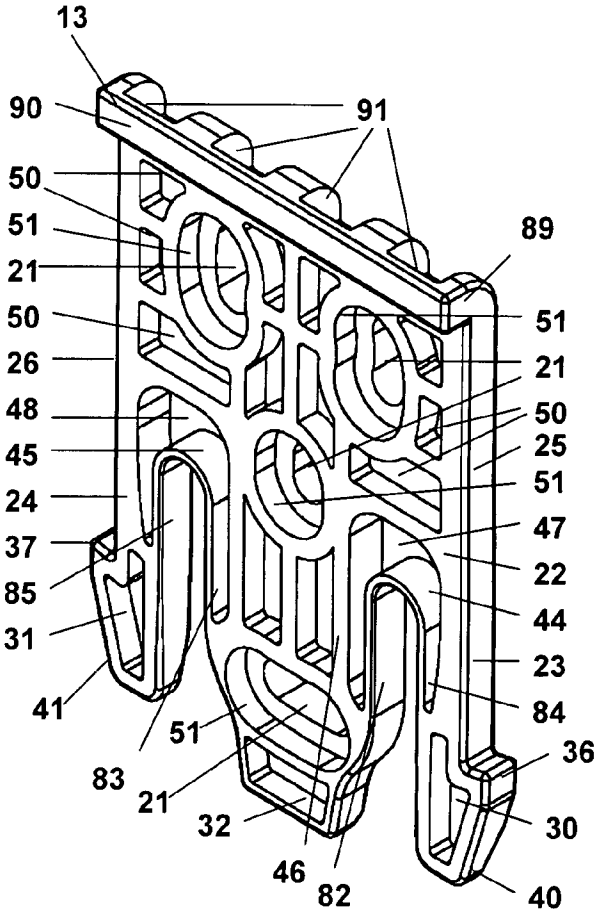
FIG. 9 is a rear perspective view of FIG. 8.
Figure 8:
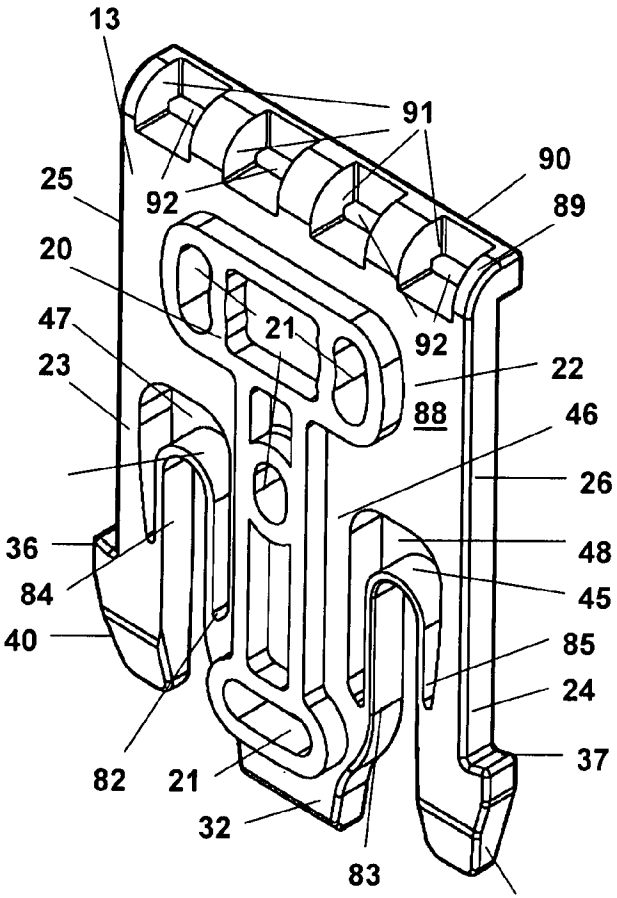
FIG. 8 is a front perspective view of the attachment mount of FIG. 1.
Figure 10:
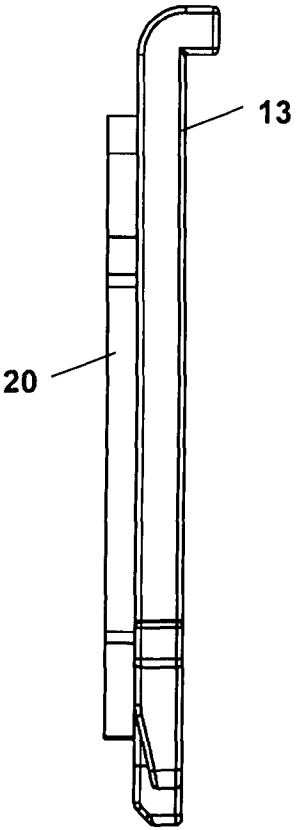
FIG. 10 is a left side elevational view of FIG. 8.
Figure 11:
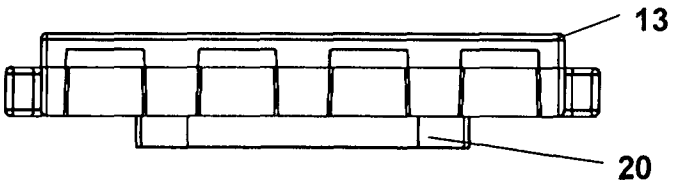
FIG. 11 is a top plan view of FIG. 8.
Figure 12:
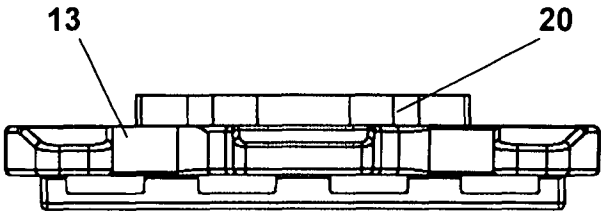
FIG. 12 is a bottom plan view of FIG. 8.

Referring now to FIGS. 8 and 9, the attachment mount 13 comprises a substantially rectangular base member 22 that has a generally T-shaped central mounting portion 20 (see FIG. 8), opposing side edges 25, 26, a foot portion 32, a generally vertical central part 46, and a front surface 88 (see FIG. 8). The generally T-shaped central mounting portion 20 is formed integral with the front surface 88 of the base member 22 and projects outwardly from the front surface 88. The foot portion 32 is centrally located in the bottom portion of the base member 22, while the generally vertical central part 46 is located medially of the base member 22. The T-shaped central mounting portion 20 includes spaced openings, preferably in the form of arcuate slots 21. The arcuate slots 21 can be used to affix a holster or other article to the attachment mount 13. An article can even be attached to the arcuate slots 21 at various angular relationships, as known in the art.

Referring now to FIG. 1, when the attachment mount 13 is positioned in the receiver 11, an outside surface of the generally T-shaped central mounting portion 20 of the base member 22 of the attachment mount 13 lies substantially in the same plane as an outside surface of the front wall 17 of the receiver 11. This places the T-shaped central mounting portion 20 forward of the pocket 12 (see FIG. 3) of the receiver 11. This alignment of the T-shaped central mounting portion 20 relative to the receiver 11 permits an article to be affixed to the attachment mount 13 yet still not impede engagement of the attachment mount 13 with the receiver 11.

Referring again to FIGS. 8 and 9, the attachment mount 13 further comprises a pair of spaced tines 23, 24. Each tine 23, 24 is positioned along one of the side edges 25, 26 of the base member 22. The tines 23, 24 are bendable or compressible toward each other so that they may be inserted into the open top 35 of the pocket 12 of the receiver 11. (See FIG. 3.) Each tine 23, 24 has a depression 30, 31 (see FIG. 9) centrally located in a lower portion of a rear side, a barb 36, 37, and a tapered lower extremity 40, 41. When the attachment mount 13 is initially inserted into the receiver 11, the tapered lower extremities 40, 41 engage the top ends 86, 87 (see FIGS. 1 and 3) of the end walls 15, 16 (see FIGS. 1 and 3) of the receiver 11. As the attachment mount 13 is slidingly forced down into the receiver 11, the lower extremities 40, 41 are forced inwardly, compressing the tines 23, 24 inwardly toward each other and allowing the attachment mount 13 to continue into the receiver 11 until the attachment mount 13 is fully seated therein, as shown in FIG. 1. At roughly the moment at which the attachment mount 13 becomes fully seated in the pocket 12 of the receiver 11, the barbs 36, 37 at the lower ends of the tines 23, 24 clear the lower ends 38, 39 of the end walls 15, 16 and the tines 23, 24 spring back outwardly from each other to their original uncompressed state, as also shown in FIG. 1.

Continuing with FIGS. 8 and 9, the attachment mount 13 further comprises a pair of leaf springs 44, 45 and a pair of open areas 47, 48. Each leaf spring 44, 45 is located between a corresponding tine 23, 24 and the generally vertical central part 46 of the base member 22 of the attachment mount 13. Each leaf spring 44, 45 is shaped generally like an inverted "U." A first end 82, 83 of each leaf spring 44, 45 is formed integral with the vertical central part 46, while an opposing second end 84, 85 of each leaf spring 44, 45 is formed integral with a corresponding tine 23, 24. Each open area 47, 48 spans a space that is above a corresponding leaf spring 44, 45 and between the generally vertical central part 46 of the base member 22 and a corresponding tine 23, 24. The open areas 47, 48 permit the leaf springs 44, 45 to be compressed when the tines 23, 24 are moved inwardly by the finger action of a user squeezing the tines 23, 24 toward each other adjacent their tapered lower extremities 40, 41. The leaf springs 44, 45 are also compressed when the tines 23, 24 are moved inwardly toward each other as a result of the attachment mount 13 being slidingly forced down through the open top 35 of the pocket 12 of the receiver 11. (See FIG. 3.)

Still referring to FIGS. 8 and 9, the attachment mount 13 further comprises an angled top 89 that curves away from the front surface 88 (see FIG. 8) of the base member of the attachment mount 13. The angled top 89 includes a rear wall 90; a plurality of hollows 91; and a like number of elongated, generally rectangular slots 92 (see FIG. 8). The hollows 91 are generally equally spaced along the length of the angled top 89. At the bottom of each hollow 91 is a slot 92. When the attachment mount 13 is inserted into the receiver 11, the slots 92 engage elements of the receiver 11, as described below with reference to FIGS. 1 and 2. This intermeshing engagement strengthens the ability of the attachment mount 13 from being pried outwardly away from the receiver 11, as by an offender attempting to grab a holstered handgun from an officer.

Referring now to FIG. 9, the attachment mount 13 further comprises a plurality of dished out areas 50, 51. It is common in the plastic injection molding art to incorporate dished out areas 50, 51 in an article to reduce the material cost and the weight of the article without significant reduction in strength. Note that the dished out areas 51 rearwardly of the arcuate slots 21 of the generally T-shaped central mounting portion 20 (see FIG. 8) of the base member 22 are dished out or enlarged because it is unnecessary that the depth of the material be equal to the combined depths of the raised T-shaped central mounting portion 20 and the base member 22. Thus, these dished out areas 51 help to reduce material and associated costs. Note also that in the present embodiment, the depressions 30, 31 in the tines 23, 24 function as dished out areas.

Figure 5:
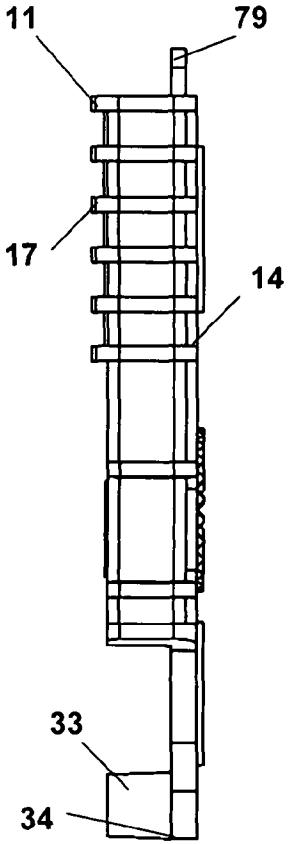
FIG. 5 is a left side elevational view of FIG. 3.
Figure 6:
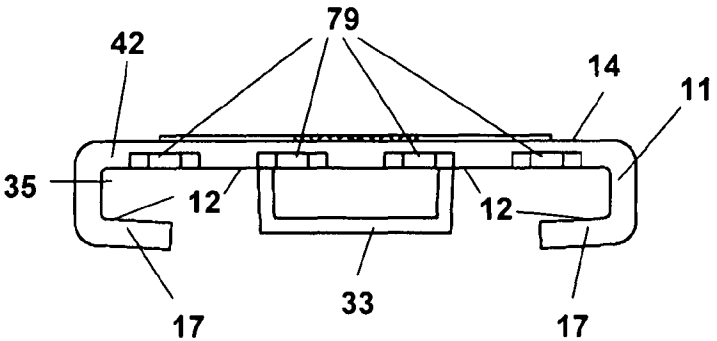
FIG. 6 is a top plan view of FIG. 3.
Figure 7:
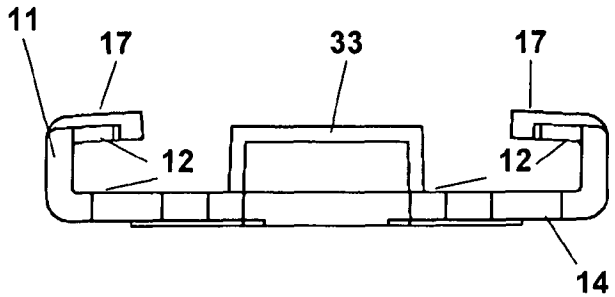
FIG. 7 is a bottom plan view of FIG. 3.

Referring now to FIGS. 3 and 5-7, the receiver 11 further comprises a generally U-shaped complemental socket 33 and a plurality of spaced, generally rectangular prominences 79 (see FIGS. 3, 5, and 6). The complemental socket 33 is formed by a band of material located centrally in the receiver 11 at a lower end portion 34 (see FIGS. 3 and 5) of the receiver 11. The complemental socket 33 extends outwardly from the inner surface 60 (see FIG. 3) of the rear wall 14 adjacent the pocket 12 (see FIGS. 3, 6, and 7). An exterior surface of the complemental socket 33 is substantially aligned with the exterior surface of the partial front wall 17. (See FIGS. 5-7.) The prominences 79 extend generally vertically from the top end 42 (see FIGS. 3 and 6) of the rear wall 14 of the receiver 11, adjacent the open top 35 (see FIGS. 3 and 6) of the pocket 12. The prominences 79 are generally equally spaced along the length of the top end 42 of the rear wall 14 and have a proximate surface substantially aligned with the inner surface 60 of the rear wall 14 adjacent the pocket 12. Note that although the preferred number of prominences 79 in the present embodiment is four, alternate embodiments can comprise a greater or fewer number of prominences 79.

Referring now to FIGS. 1 and 2, as the attachment mount 13 is slidingly inserted into the receiver 11, the foot portion 32 (see FIG. 2) of the base member 22 (see FIG. 1) of the attachment mount 13 is aligned with the space bounded by the complemental socket 33 of the receiver 11, and the slots 92 (see FIG. 8) in the hollows 91 (see FIG. 1) of the angled top 89 of the attachment mount 13 are aligned with the prominences 79 (see FIG. 1) of the top end 42 (see FIGS. 3 and 4) of the rear wall 14 of the receiver 11. When the attachment mount 13 is fully seated in the receiver 11, the foot portion 32 is itself fully seated in the complemental socket 33 of the receiver 11, and the barbs 136, 137 at the lower ends of the tines 123, 124, having cleared the lower ends 138, 139 of the end walls 115, 116, now allow the tines 123, 124 to spring back to their original uncompressed state. In addition, the slots 92 have been lowered down over the prominences 79 so that the prominences 79 extend through the slots 92 and up through the hollows 91, with the top of the prominences 79 substantially flush with the top of the angled top 89. An exterior surface of the rear wall 90 (see FIG. 2) of the angled top 89 is generally aligned along the same plane as the exterior surfaces of the spline arrangements 43, 49 (see FIG. 2) of the rear wall 14 of the receiver 11. The attachment mount 13 is thus firmly secured in the pocket 12 and to the receiver 11 by way of the foot portion 32 seated in the complemental socket 33, the prominences 79 extending through the slots 92 in the hollows 91, and the barbs 36, 37 of the tines 23, 24 engaged beneath the lower ends 38, 39 of the end walls 15, 16.

Continuing with FIGS. 1 and 2, the barbs 36, 37 of the tines 23, 24 are clearly depicted as being engaged with the lower ends 38, 39 of the end walls 15, 16 of the receiver 11. When the tines 23, 24 are compressed inwardly toward each other to allow the barbs 36, 37 to clear the lower ends 38, 39, the attachment mount 13 may be slid upwardly and removed from the receiver 11. Note that the slots 92 in the hollows 91 of the angled top 89 of the attachment mount 13 slide over the prominences 79 of the receiver 11, thereby causing no impediment to the disengagement of the attachment mount 13 from the receiver 11.

It is to be noted that the attachment mount 13 is molded from rigid plastic material capable of being bent in certain directions, in this case toward each other, so that the barbs 36, 37 of the tines 23, 24 may fit within the confines of the spaced end walls 15, 16 of the receiver 11, thereby permitting the attachment mount 13 to be upwardly slid out of the receiver 11. Likewise, the receiver 11 is made of the same or similar material.

FIGS. 13-32 depict a second preferred embodiment of the attachment mount and receiver system, designated generally by reference numeral 110, that provides a further way of releasably securing the attachment mount 113 within the receiver 111. The attachment mount and receiver system 110 includes an outer receiver 111 and an attachment mount 113 with the receiver 111 configured to slidingly receive the attachment mount 113, whereupon the attachment mount 113 and receiver 111 are releasably engaged, as will be explained more fully herebelow.

Figure 13:
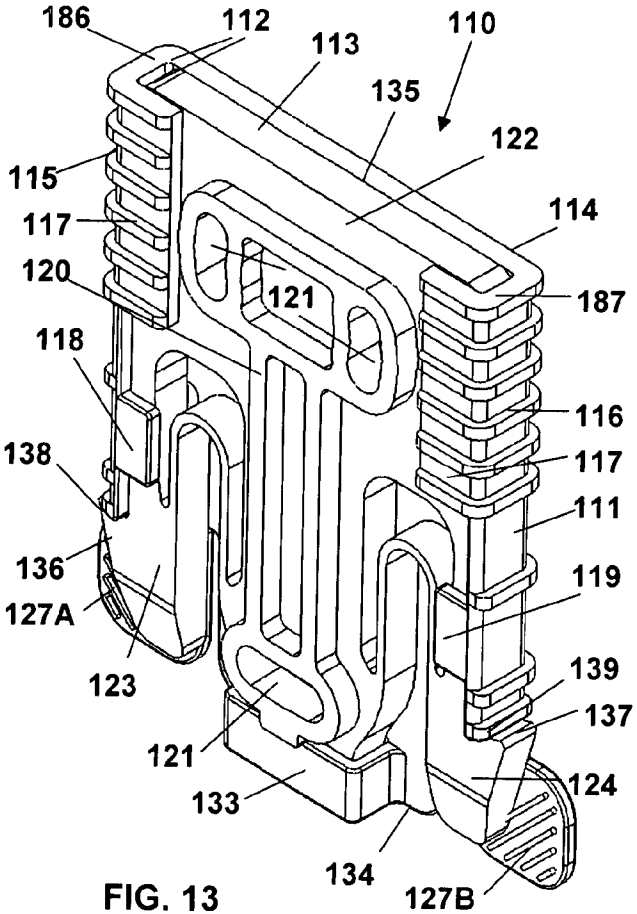
FIG. 13 is a front perspective view of a second embodiment of an attachment mount inserted into a receiver, in accord with the present invention.

Referring now to FIG. 13, the receiver 111 comprises a pocket 112 that is bounded by a rear wall 114 with an inner surface 160 (see FIGS. 15, 16, and 20); a pair of spaced opposing end walls 115, 116, each with a lower end 138, 139 and a top end 186, 187; a partial front wall 117; and a pair of spaced opposing alignment flanges 118, 119. The pocket 112 has an open top 135 through which the attachment mount 113 is received. The partial front wall 117 assists in maintaining the attachment mount 113 within the receiver 111. The alignment flanges 118, 119 are located between the partial front wall 117 and the lower ends 138, 139 of the end walls 115, 116, with one of the alignment flanges 118, 119 adjacent each opposing end wall 115, 116. The alignment flanges 118, 119 help align the attachment mount 113 as it is being slidingly inserted into or slidingly withdrawn from the receiver 111, so as to keep the attachment mount 113 within the pocket 112 of the receiver 111 as the attachment mount 113 is being inserted or withdrawn.

Figure 14:
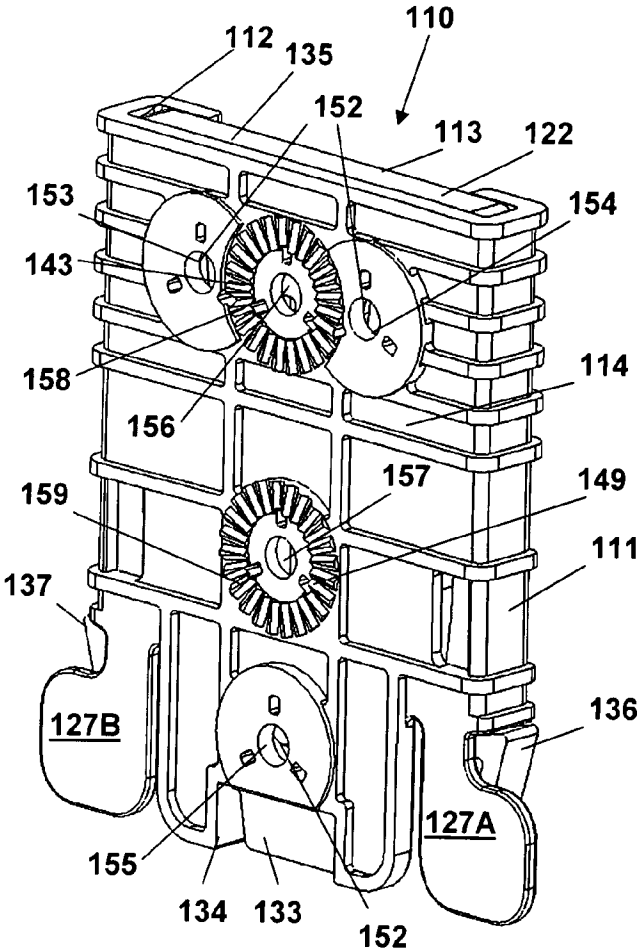
FIG. 14 is a rear perspective view of FIG. 13.

Referring now to FIG. 14, the rear wall 14 of the receiver 111 includes a hole pattern 152 that has two horizontally spaced holes 153, 154 and a vertically spaced hole 155, common in the art. One or more connectors (not shown) can be passed through these holes 153, 154, 155 to attach the receiver 111 to a support (not shown). As understood in the art, if two or more of the holes 153, 154, 155 of the hole pattern 152 are used to attach the receiver 111 to a support, then the receiver 111 will be in a locked position on the support. One such type of support to which the receiver 111 can be attached is a platform as described in Provisional '857. Such a platform can be releasably attached to webbing of a MOLLE/PALS compliant garment or to a similarly designed garment, as also described in Provisional '857.

Continuing with FIG. 14, the rear wall 14 of the receiver 111 also includes a pair of spaced spline arrangements 143, 149, an upper spline arrangement 143 and a lower spline arrangement 149. The upper spline arrangement 143 includes a locking spline 158 surrounding an attaching hole 156. The locking spline 158 can engage a compatible spline of a support (not shown) and a connector (not shown) can be passed through the attaching hole 156 to attach the receiver 111 to the support. Likewise, the lower spline arrangement 149 also includes a locking spline 159 surrounding an attaching hole 157. This locking spline 159 also can engage a compatible spline of a support and the attaching hole 157 can be used to attach the receiver 111 to the support. In addition, if a support has a spline that is compatible with both locking splines 158, 159, then either of the locking splines 158, 159 can engage the spline of the support to dispose the receiver 111 in a number of angled positions. The angular relationship between the receiver 111 and the support will be in increments of approximately 15°. Of course, if the support includes two compatible splines and both splines are affixed to both locking splines 158, 159 of the receiver 111, then the angled positions that the receiver 111 can assume will be limited likely to only two positions, one position approximately 180° relative to the other position.

Regarding FIG. 14, one type of support to which the receiver 111 can be attached is a platform as described in Provisional '125 and as shown in FIGS. 16 and 17 of that application. Such a platform contains a spline compatible with the locking splines 158, 159 of the receiver 111. Both the hole pattern 152 and the upper and lower spline arrangements 143, 149 of the receiver 111 provide a number of different attachment possibilities that permit the receiver 111 to be attached to many differently-configured supports and the like.

Figure 19:
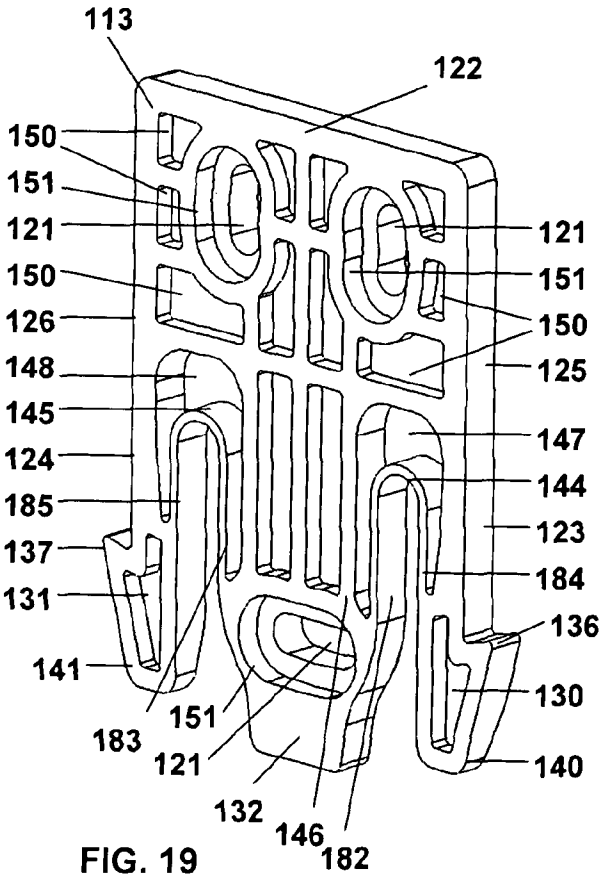
FIG. 19 is a rear perspective view of FIG. 18.
Figure 18:
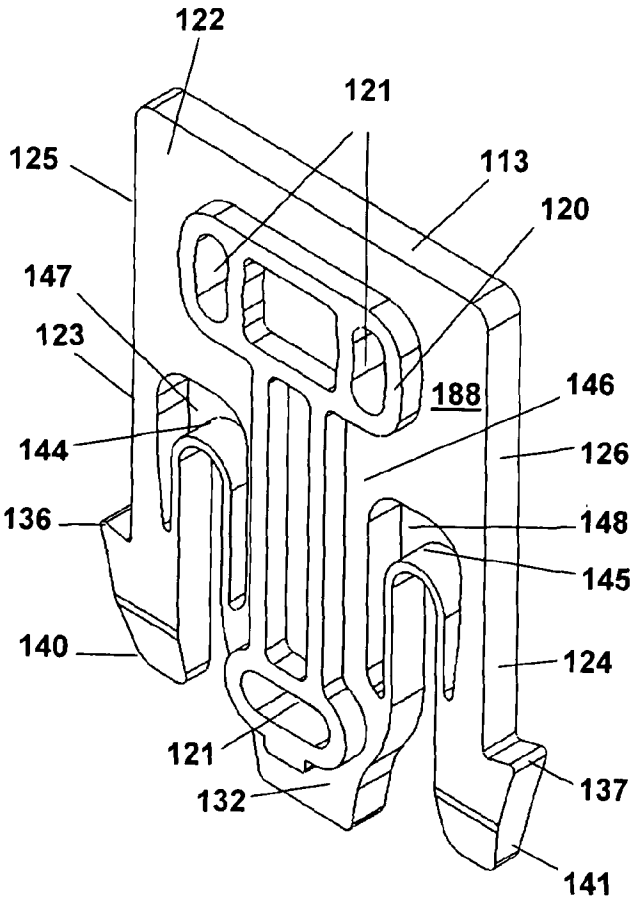
FIG. 18 is a front perspective view of the attachment mount of FIG. 13.

Referring now to FIGS. 18 and 19, the attachment mount 113 comprises a substantially rectangular base member 122 that has a generally T-shaped central mounting portion 120 (see FIG. 18), opposing side edges 125, 126, a foot portion 132, a generally vertical central part 146, and a front surface 188 (see FIG. 18). The generally T-shaped central mounting portion 120 is formed integral with the front surface 188 of the base member 122 and projects outwardly from the front surface 188. The foot portion 132 is centrally located in the bottom portion of the base member 122, while the generally vertical central part 146 is located medially of the base member 122. The T-shaped central mounting portion 120 includes spaced openings, preferably in the form of arcuate slots 121. The arcuate slots 121 can be used to affix a holster or other article to the attachment mount 113. An article can even be attached to the arcuate slots 121 at various angular relationships, as known in the art.

Figure 25:
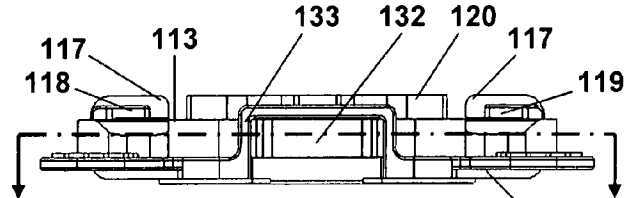
FIG. 25 is a bottom plan view of FIG. 22.
Figure 27:
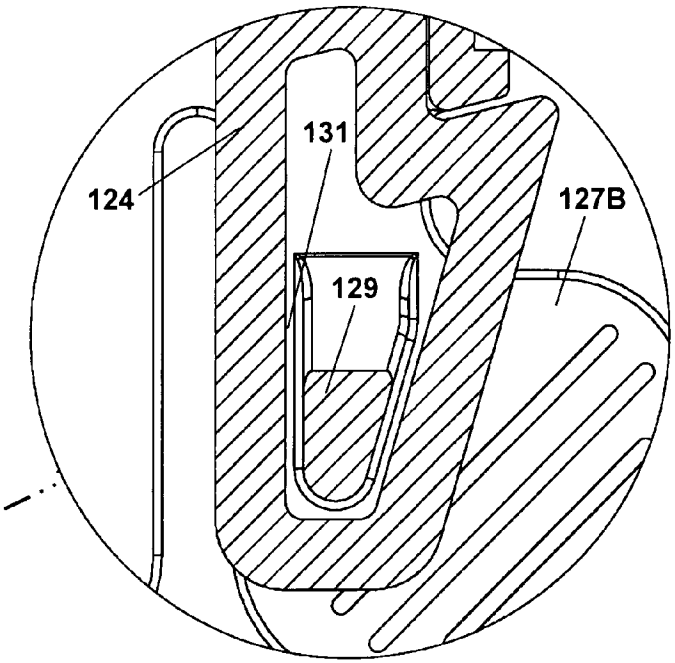
FIG. 27 is an enlarged partial view of FIG. 26.
Figure 26:
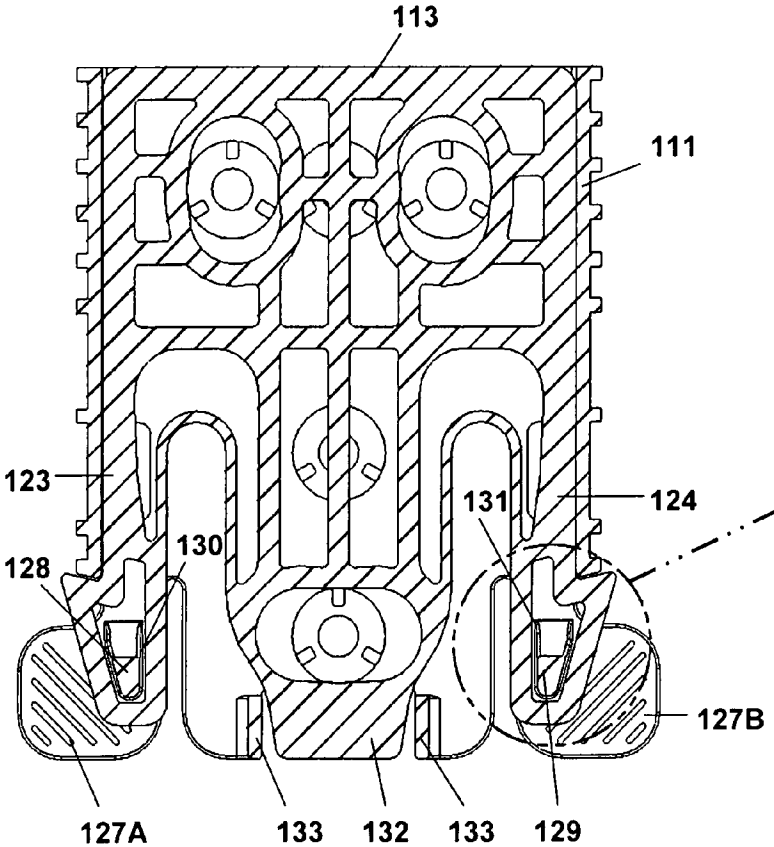
FIG. 26 is a cross-sectional view taken along line 26-26 of FIG. 25.
Figure 28:
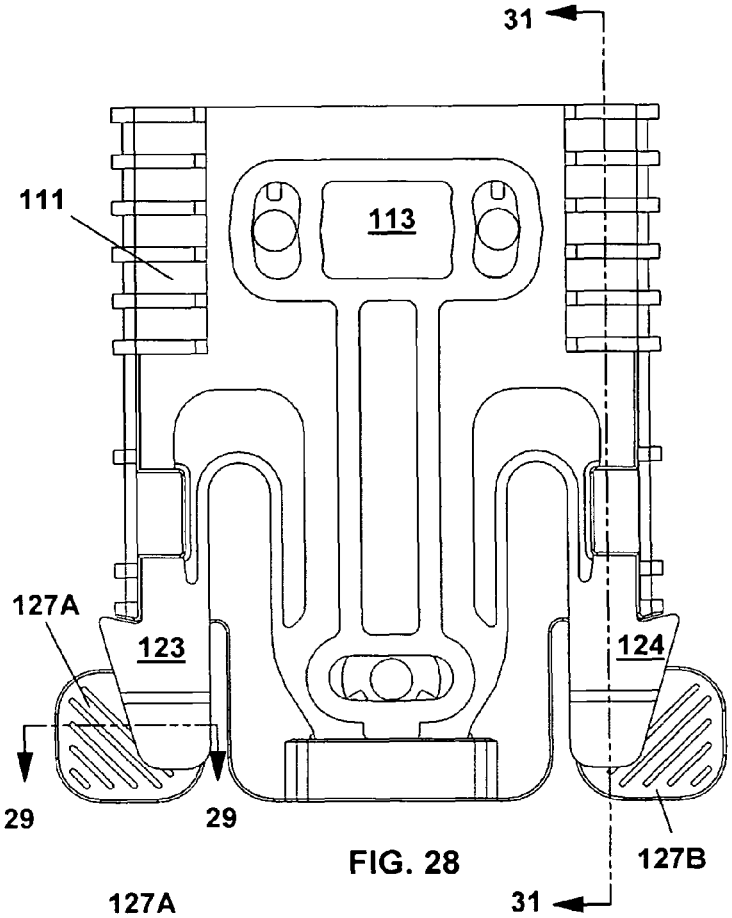
FIG. 28 is an enlarged front elevational view of FIG. 13.
Figure 31:
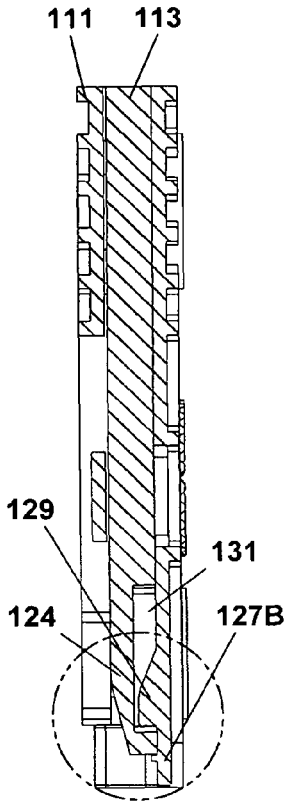
FIG. 31 is a cross-sectional view taken along line 31-31 of FIG. 28.
Figure 29:
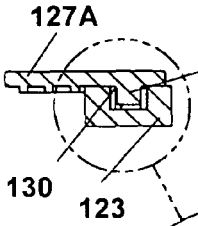
FIG. 29 is a cross-sectional partial view taken along line 29-29 of FIG. 28 and showing the lock between the attachment mount and the receiver.
Figure 30:
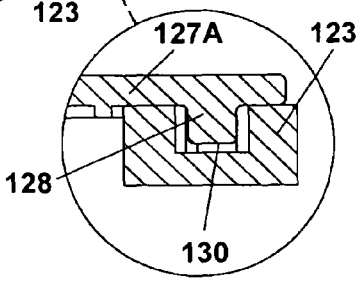
FIG. 30 is an enlarged partial view of FIG. 29.
Figure 32:
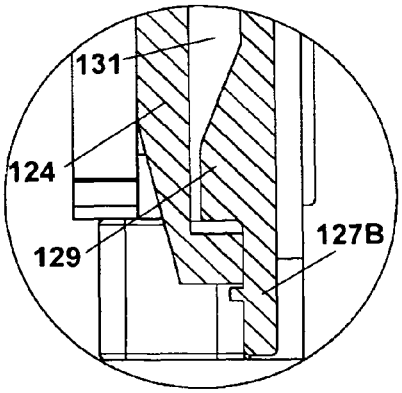
FIG. 32 is an enlarged partial view of FIG. 31.

Referring now to FIG. 25, when the attachment mount 113 is positioned in the receiver 111, an outside surface of the generally T-shaped central mounting portion 120 of the base member 122 of the attachment mount 113 lies substantially in the same plane as an outside surface of the front wall 117 of the receiver 111. This places the T-shaped central mounting portion 120 forward of the pocket 112 of the receiver 111. This alignment of the T-shaped central mounting portion 120 relative to the receiver 111 permits an article to be affixed to the attachment mount 113 yet still not impede engagement of the attachment mount 113 with the receiver 111.

Figure 20:
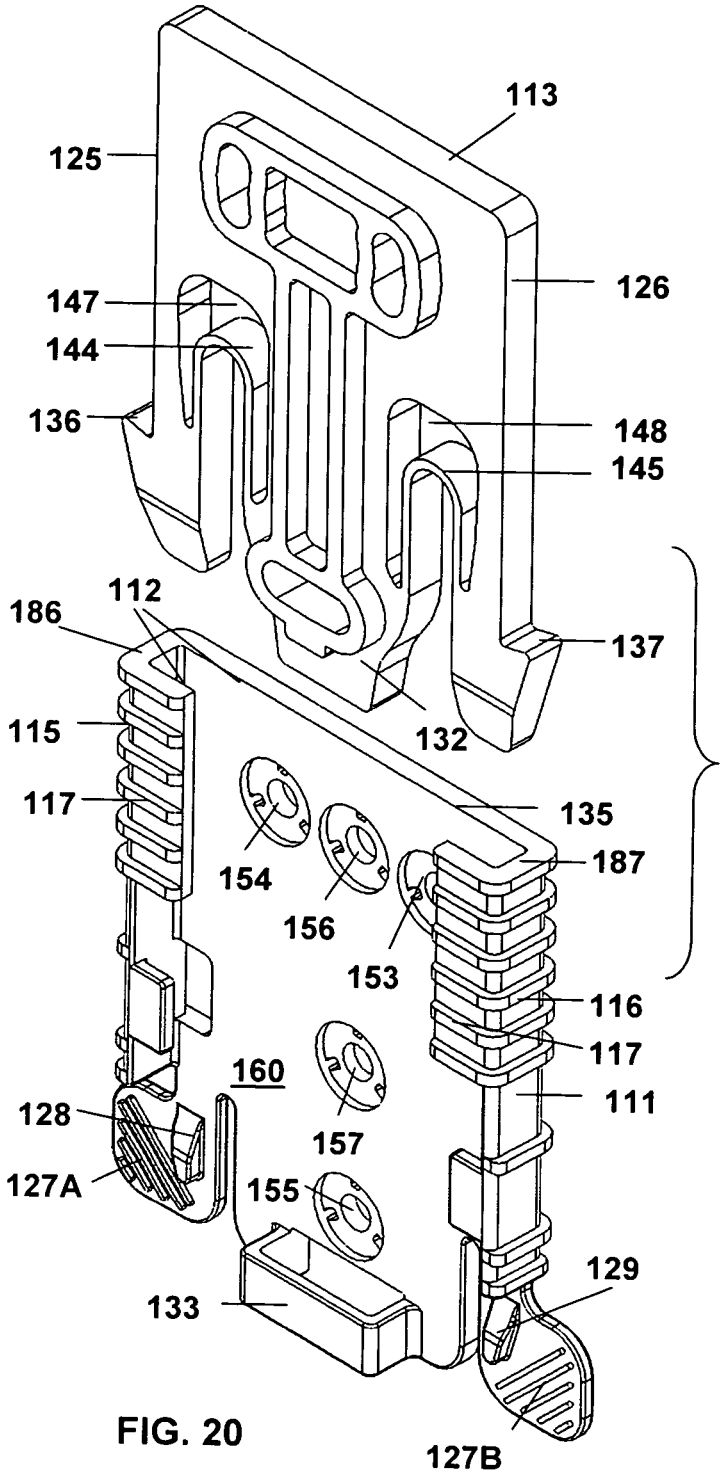
FIG. 20 is an exploded front perspective view of FIG. 13.
Figure 21:
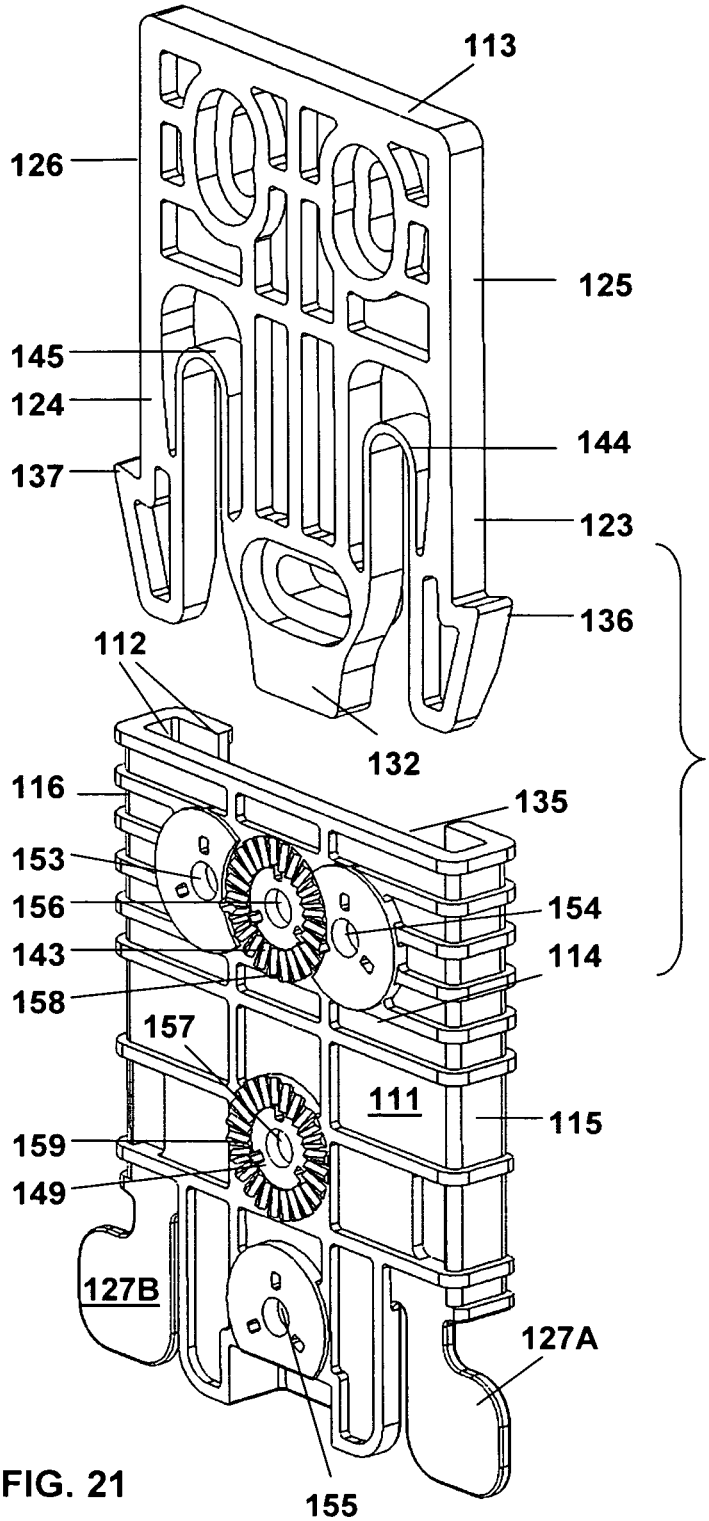
FIG. 21 is an exploded rear perspective view of FIG. 13.
Figure 24:
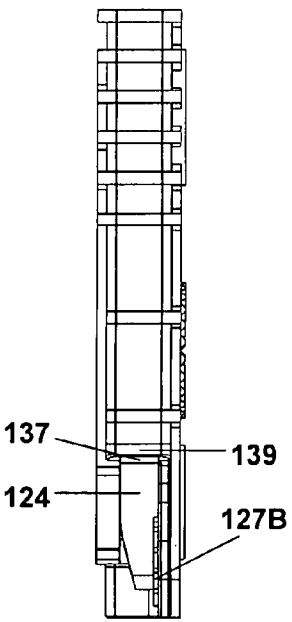
FIG. 24 is a left side elevational view of FIG. 22.
Figure 23:
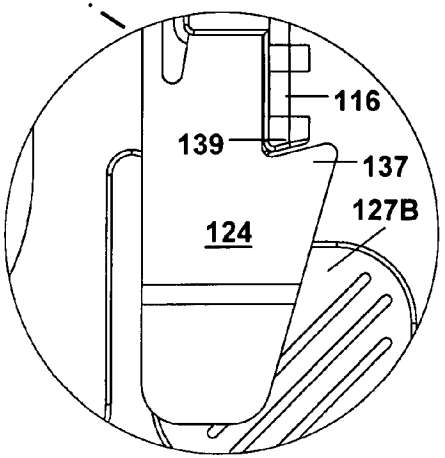
FIG. 23 is an enlarged partial view of FIG. 22.

Referring again to FIGS. 18 and 19, the attachment mount 113 further comprises a pair of spaced tines 123, 124. Each tine 123, 124 is positioned along one of the side edges 125, 126 of the base member 122. The tines 123, 124 are bendable or compressible toward each other so that they may be inserted into the open top 135 of the pocket 112 of the receiver 111, as shown in FIGS. 20 and 21. Each tine 123, 124 has a depression 130, 131 (see FIG. 19) centrally located in a lower portion of a rear side, a barb 136, 137, and a tapered lower extremity 140, 141. When the attachment mount 113 is initially inserted into the receiver 111, the tapered lower extremities 140, 141 engage the top ends 186, 187 of the end walls 115, 116 (see FIGS. 20 and 21) of the receiver 111. As the attachment mount 113 is slidingly forced down into the receiver 111, the lower extremities 140, 141 are forced inwardly, compressing the tines 123, 124 inwardly and allowing the attachment mount 113 to continue into the receiver 111 until the attachment mount 113 is fully seated therein, as shown in FIG. 13. At roughly the moment at which the attachment mount 113 becomes fully seated in the pocket 112 of the receiver 111, the barbs 136, 137 at the lower ends of the tines 123, 124 clear the lower ends 138, 139 of the end walls 115, 116 and the tines 123, 124 spring back to their original uncompressed state, as also shown in FIG. 13. At this point, the depressions 130, 131 of the tines 123, 124 engage elements of the receiver 111 further enhancing the lock between the attachment mount 113 and the receiver 111, as described below with reference to FIGS. 15-17. (Also see FIGS. 26-32.)

Continuing with FIGS. 18 and 19, the attachment mount 113 further comprises a pair of leaf springs 144, 145 and a pair of open areas 147, 148. Each leaf spring 144, 145 is located between a corresponding tine 123, 124 and the generally vertical central part 146 of the base member 122 of the attachment mount 113. Each leaf spring 144, 145 is shaped generally like an inverted "U." A first end 182, 183 of each leaf spring 144, 145 is formed integral with the vertical central part 146, while an opposing second end 184, 185 of each leaf spring 144, 145 is formed integral with a corresponding tine 123, 124. Each open area 147, 148 spans a space that is above a corresponding leaf spring 144, 145 and between the generally vertical central part 146 of the base member 122 and a corresponding tine 123, 124. The open areas 147, 148 permit the leaf springs 144, 145 to be compressed when the tines 123, 124 are moved inwardly by the finger action of a user squeezing the tines 123, 124 toward each other adjacent their tapered lower extremities 140, 141. The leaf springs 144, 145 are also compressed when the tines 123, 124 are moved inwardly toward each other as a result of the attachment mount 113 being slidingly forced down through the open top 135 of the pocket 112 of the receiver 111, as shown in FIGS. 20 and 21.

Referring now to FIG. 19, the attachment mount 113 further comprises a plurality of dished out areas 150, 151. It is common in the plastic molding art to incorporate dished out areas 150, 151 in an article to reduce the material cost and the weight of the article. Note that the dished out areas 151 rearwardly of the arcuate slots 121 of the generally T-shaped central mounting portion 120 (see FIG. 18) of the base member 122 are dished out or enlarged because it is unnecessary that the depth of the material be equal to the combined depths of the raised T-shaped central mounting portion 120 and the base member 122. Thus, these dished out areas 151 help to reduce material and associated costs.

Figure 15:
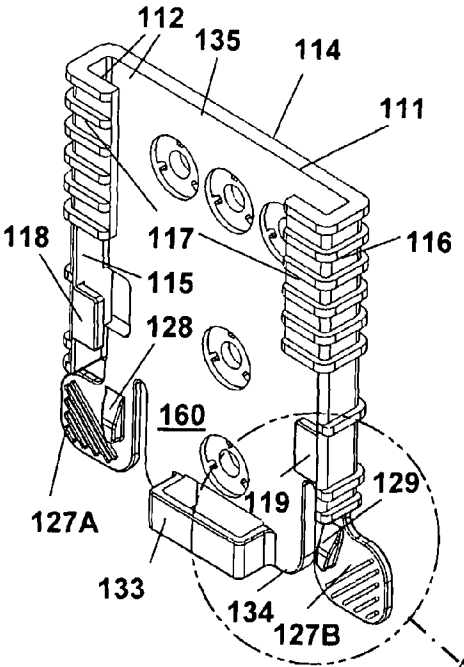
FIG. 15 is a front perspective view of the receiver of FIG. 13 with the attachment mount withdrawn therefrom.

Referring now to FIGS. 15-17, the receiver 111 further comprises a pair of spaced flanges 127A, 127B with a finger 128, 129 (see FIGS. 15 and 16) extending generally laterally from each of the respective flanges 127A, 127B, and a generally U-shaped complemental socket 133. The complemental socket 133 is formed by a band of material located centrally in the receiver 111 at a lower end portion 134 (see FIGS. 15 and 16) of the receiver 111. The complemental socket 133 extends outwardly from the inner surface 160 (see FIGS. 15 and 16) of the rear wall 114 (see FIGS. 15 and 17) adjacent the pocket 112 (see FIGS. 15 and 17). An exterior surface of the complemental socket 133 is substantially aligned with the exterior surface of the partial front wall 117. (See FIG. 25.)

Each flange 127A, 127B is juxtaposed with a corresponding tine 123, 124 of the attachment mount 113, as shown in FIGS. 13, 22, 23, and 26-32.

Referring now to FIGS. 26-32, the finger 128, 129 of each respective flange 127A, 127B extends outwardly such that the finger 128, 129 locks into the depression 130, 131 of a respective tine 123, 124 when the attachment mount 113 is fully seated in the receiver 111. When the attachment mount 113 is fully seated in the receiver 111, the foot portion 132 of the base member 122 of the attachment mount 113 is itself fully seated in the complemental socket 133 of the receiver 111, as shown most clearly in FIG. 26. The attachment mount 113 is thus firmly secured to the receiver 111 by way of the foot portion 132 being seated in the complemental socket 133, the barbs 136, 137 of the tines 123, 124 being engaged beneath the lower ends 138, 139 of the end walls 115, 116, and the fingers 128, 129 of the flanges 127A, 127B being seated within the depressions 130, 131 of the tines 123, 124.

Figure 22:
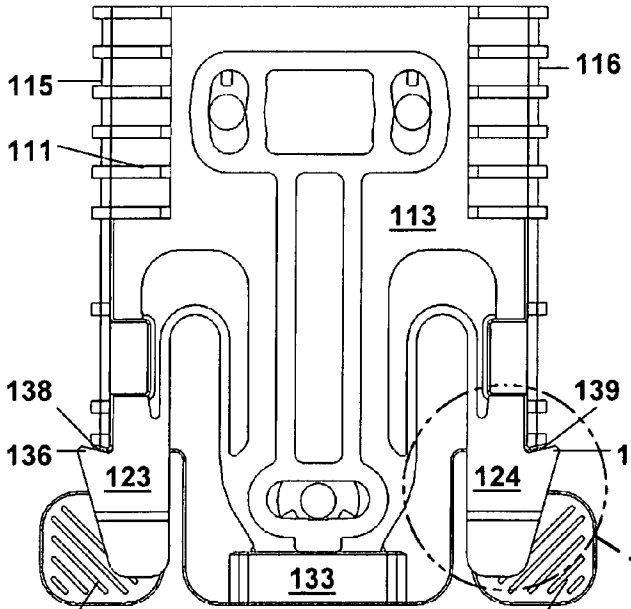
FIG. 22 is a front elevational view of FIG. 13.

Referring now to FIGS. 22-25, the barbs 136, 137 of the tines 123, 124 are clearly depicted as being engaged with the lower ends 138, 139 of the end walls 115, 116 of the receiver 111 in FIG. 22. When the tines 123, 124 are compressed inwardly toward each other to allow the barbs 136, 137 to clear the lower ends 138, 139, the attachment mount 113 may be slid upwardly and removed from the receiver 111. The tines 123, 124 cannot be compressed toward each other, however, until the flanges 127A, 127B are depressed rearwardly so that the fingers 128, 129 of the flanges 127A, 127B are clear of their locking engagement with the depressions 130, 131 of the tines 123, 124, as shown in FIGS. 26-32. After that is accomplished, the tines 123, 124 may be compressed inwardly toward each other so that the barbs 136, 137 of the tines 123, 124 clear the lower ends 138, 139 of the end walls 115, 116, whereupon the attachment mount 113 may be slid upwardly to remove the attachment mount 113 from the receiver 111.

It is to be noted that the attachment mount 113 is molded from rigid plastic material capable of being bent in certain directions, in this case toward each other, so that the barbs 136, 137 of the tines 123, 124 may fit within the confines of the spaced end walls 115, 116 of the receiver 111, thereby permitting the attachment mount 113 to be upwardly slid out of the receiver 111. Likewise, the receiver 111 is made of the same or similar material.

Figure 35:
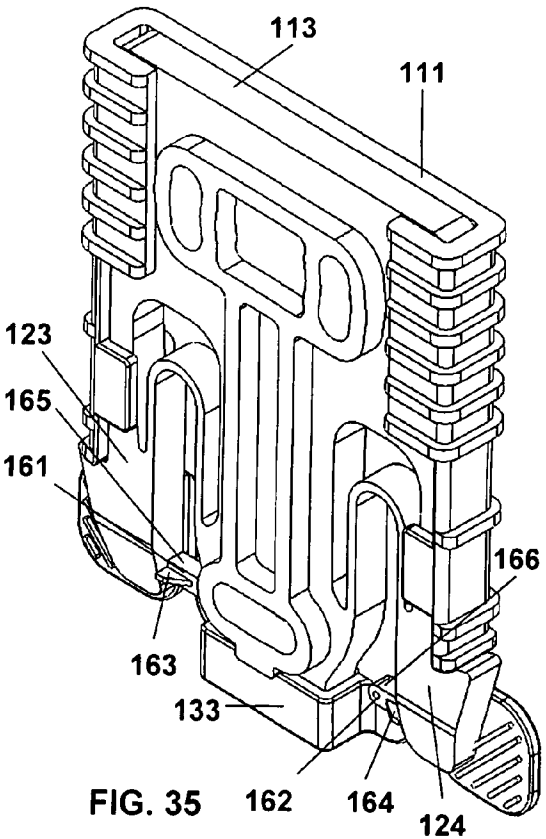
FIG. 35 is a front perspective view of FIG. 33.
Figure 33:
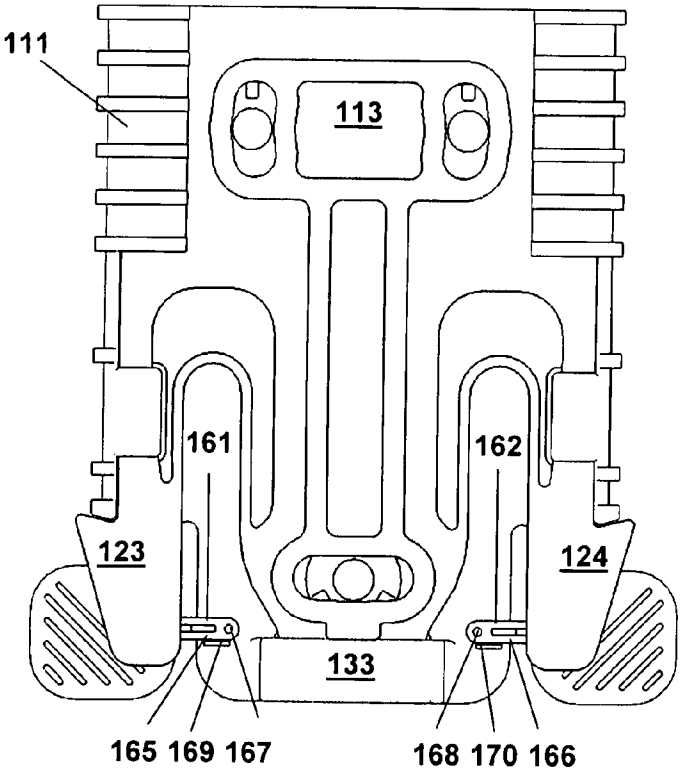
FIG. 33 is a front elevational view similar to FIG. 13 showing a third embodiment of an attachment mount inserted into a receiver, in accord with the present invention.
Figure 34:
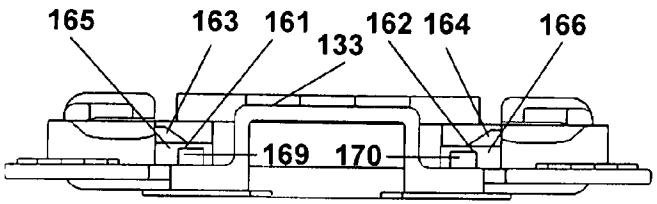
FIG. 34 is a bottom plan view of FIG. 33.

FIGS. 33-35 depict a third preferred embodiment of the attachment mount and receiver system 110 that provides a further way of releasably securing the attachment mount 113 within the receiver 111.

Referring now to FIGS. 33-35, the receiver 111 comprises a pair of spaced lever mechanisms 161, 162. The lever mechanisms 161, 162 are attached to the receiver 111 proximate the complemental socket 133 of the receiver 111, with each lever mechanism 161, 162 located between the complemental socket 133 and a respective tine 123, 124 of the attachment mount 113. Each lever mechanism includes a manipulation flange 163, 164 a lock bar or lever 165, 166, a pivot pin 167, 168 (see FIGS. 33 and 35), and a lever stop 169, 170 (see FIGS. 33 and 34). The levers 165, 166 engage respective tines 123, 124 in the position shown such that the tines 123, 124 cannot be compressed inwardly toward each other. The levers 165, 166 may be rotated upwardly about pivot pins 167, 168 so that the levers 165, 166 are positioned within the confines of the mid-portion of the receiver 111. In this alignment, the levers 165, 166 do not prevent inward compression of the tines 123, 124.

Continuing with FIGS. 33-35, as shown, each lever 165, 166 has a locking horizontal position determined by the spaced lever stops 169, 170. To release the attachment mount 113 from the receiver 111, one can use the manipulation flange 163, 164 on each lever 165, 166 to push the levers 165, 166 upwardly. The levers 165, 166 are now aligned to permit the attachment mount 113 to be removed from the receiver 111. The flanges 127A, 127B of the receiver 111 can now be depressed rearwardly to clear their locking engagement with the tines 123, 124, the tines 123, 124 can then be compressed inwardly toward each other, and the attachment mount 113 can be slid upwardly to remove the attachment mount 113 from the receiver 111, as described above with reference to FIGS. 22-25.

Figure 38:
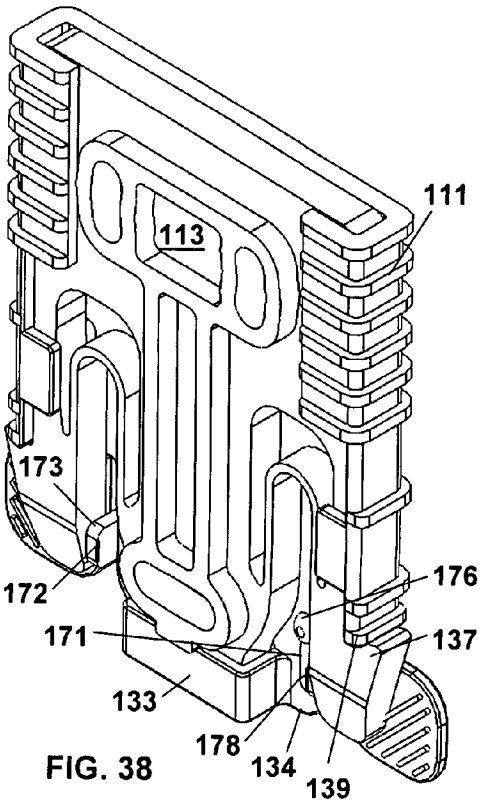
FIG. 38 is a front perspective view of FIG. 36.
Figure 36:
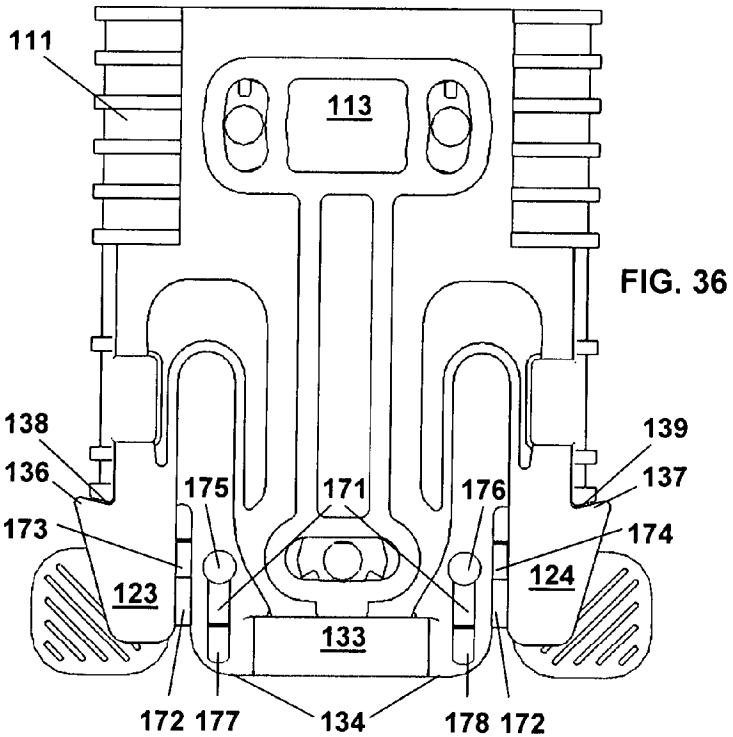
FIG. 36 is a front elevational view similar to FIGS. 13 and 33 showing a fourth embodiment of an attachment mount inserted into a receiver, in accord with the present invention.
Figure 37:
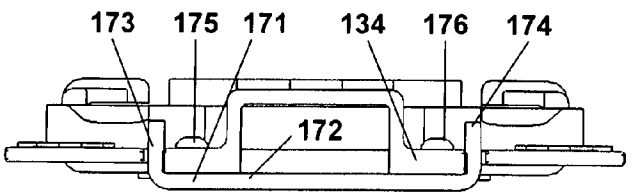
FIG. 37 is a bottom plan view of FIG. 36.

FIGS. 36-38 depict a fourth preferred embodiment of the attachment mount and receiver system 110 that provides yet another way of releasably securing the attachment mount 113 within the receiver 111.

Referring now to FIGS. 36-38, the receiver 111 comprises a bar mechanism 171 attached proximate the lower end portion 134 of the receiver 111. The bar mechanism 171 includes a generally U-shaped bar 172 with two opposing ends 173, 174; a pair of rivets or guide pins 175, 176; and a pair of spaced, vertical elongate slots 177, 178 (see FIGS. 36 and 38). Each slot 177, 178 is located between the complemental socket 133 of the receiver 111 and a respective tine 123, 124 of the attachment mount 113. Each guide pin 175, 176 extends through a respective slot 177, 178 and attaches to the U-shaped bar 172 positioned behind the slots 177, 178. Each end 173, 174 of the U-shaped bar 172 extends outwardly toward the front wall 117 of the receiver 111 and between a respective slot 177, 178 and a respective tine 123, 124.

Continuing with FIGS. 36-38, the guide pins 175, 176 are configured to slide in the slots 177, 178. When each guide pin 175, 176 is positioned at the top of a respective slot 177, 178, the ends 173, 174 of the U-shaped bar 172 engage the tines 123, 124 in the position shown to prevent compression thereof. As the guide pins 175, 176 are lowered in the slots 177, 178 toward the lower end portion 134 of the receiver 111, the U-shaped bar 172 to which the guide pins 175, 176 are attached also lowers, until the ends 173, 174 of the U-shaped bar 172 clear the tapered lower extremities 140, 141 of the tines 123, 124. With the ends 173, 174 of the U-shaped bar 172 now clear of the tines 123, 124, the attachment mount 113 can be removed from the receiver 111. To remove the attachment mount 113 from the receiver 111, the flanges 127A, 127B of the receiver 111 are depressed rearwardly to clear their locking engagement with the tines 123, 124, the tines 123, 124 are then compressed inwardly toward each other, and the attachment mount 113 is slid upwardly to remove the attachment mount 113 from the receiver 111, as described above with reference to FIGS. 22-25.

It is to be understood that any of the embodiments of the present invention shown throughout this disclosure may be provided with the flanges 127A, 127B and the fingers 128, 129 of the receiver 111 and the depressions 130, 131 of the tines 123, 124 of the attachment mount 113 that are shown in FIGS. 13-32 to provide a releasable engagement between the attachment mount 113 and the receiver 111. Similarly, the attachment mount 13 and the receiver 11 depicted in FIGS. 1-12 can be modified to include additional releasable engagement means as well, such as those releasable engagement means depicted in FIGS. 33-35 or FIGS. 36-38. It is also to be understood that the U-shaped bar 172 of the bar mechanism 171 of the receiver 111 could be detached from the receiver 111 and made into a snap on and off construction without departing from the invention herein disclosed. A disadvantage of this could be that such a small and separate component could become lost.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. An attachment mount and receiver system for removably attaching articles to a garment comprising:

a receiver having a pocket for receiving an attachment mount, said pocket being bounded by a pair of opposing end walls, a pair of spaced partial front walls extending substantially perpendicularly between said end walls with each said front wall having an end formed integrally with a respective said end wall, a rear wall generally parallel with said front walls and extending perpendicularly between said end walls, said rear wall having opposing ends with each said end being formed integrally with a respective said end wall; said rear wall including a top portion, an inner surface, a bottom portion, and a plurality of spaced openings extending through said rear wall for affixing a support thereto; and said attachment mount having a pair of opposing side edges; a substantially planar base member containing a front surface, a substantially vertical central part located generally medially of said base member, and a plurality of spaced openings extending through said central part of said base member for affixing an article thereto; said central part of said base member including a raised mounting portion formed integrally with said front surface of said base member and projecting outwardly, said mounting portion being substantially parallel to said from surface of said base member, said openings of said base member, extending through said mounting portion; a pair of spaced tines, each said tine being adjacent respective said side edges and each with a tapered lower extremity and a barb for engaging a lower end of each said end wall of said receiver; and a pair of spaced springs, each said spring having a pair of opposing ends being located between a respective said tine and said central part for permitting compression of said tines toward each other, said springs being uncompressed when said barbs respectively engage said lower ends of said end walls of said receiver.

2. The attachment mount and receiver system as defined in claim 1, wherein a first said end of each said spring being formed integrally with a proximate side of said central part and a second said end formed integrally with a proximate side of a respective said tine; said tines and said springs selectively removably secure said attachment mount to said receiver.

3. The attachment mount and receiver system as defined in claim 1, wherein:

said base member of said attachment mount includes a reduced foot portion located generally medially of a bottom portion of said central part of said base member; and said receiver further includes a complemental socket located generally medially of said bottom portion of said inner surface of said rear wall of said receiver and projecting outwardly from said inner surface for receiving said foot portion, said socket being spaced laterally from each said tine and generally the dimensions of said reduced foot portion.

4. The attachment mount and receiver system as defined in claim 3, wherein said rear wall of said receiver further includes at least one radial spline connection having an attaching hole extending through said rear wall surrounded by spline connection for affixing said receiver to a complemental spline on a support allowing for said receiver to be affixed at a plurality of angles relative to such support.

5. The attachment mount and receiver system as defined in claim 3, further comprising resistance means for inhibiting prying of said attachment mount outwardly toward said front walls and away from said receiver.

6. The attachment mount and receiver system as defined in claim 5, wherein said resistance means include:

said rear wall of said receiver having a plurality of spaced prominences extending generally vertically from said top end of said rear wall; and said attachment mount having a top portion opposing said foot portion of said base member, said stop portion including a plurality of spaced openings, constructed and arranged to receive said prominences of said rear wall of said receiver there through to intermesh said attachment mount with said receiver.

7. The attachment mount and receiver system as defined in claim 5, further comprising movable tine blocking means for removably inhibiting inward compression of said tines of said attachment mount when said attachment mount is fully seated within said receiver.

8. The attachment mount and receiver system as defined in claim 7, wherein said tine blocking means include a pair of spaced, generally planar flanges each located proximate said lower end of a respective said end wall of said receiver and aligned substantially coplanar with said rear wall of said receiver, each said flange having a finger extending outwardly toward said front walls of said receiver; and each said tine of said attachment mount having a rear surface with a depression for receiving said finger of a respective said flange when said attachment mount is fully seated within said receiver to inhibit inward compression of said tines.

9. The attachment mount and receiver system as defined in claim 7, wherein said tine blocking means include a pair of spaced levers each pivotally attached to said bottom portion of said inner surface of said rear wall of said receiver between said end walls of said receiver, each said lever being movable to block inward compression of a respective proximate said tine of said attachment mount when said attachment mount is fully seated within said receiver and to unblock same.

10. The attachment mount and receiver system as defined in claim 7, wherein said tine blocking means include an elongated bar having opposing ends extending outwardly toward said front walls of said receiver, said bar being slidingly attached to said bottom portion of said inner surface of said rear wall of said receiver between said end walls of said receiver, said bar being movable to block inward compression of said tines of said attachment mount when said attachment mount fully seated within said receiver and to unblock same.

11. The attachment mount and receiver system as defined in claim 1, further comprising resistance means for inhibiting prying of said attachment mount outwardly toward said front walls and away from said receiver.

12. The attachment mount and receiver system as defined in claim 11, wherein said resistance means include:

said rear wall of said receiver having a plurality of spaced prominences extending generally vertically from said top end of said rear wall; and said attachment mount having a top portion opposing said foot portion of said base member, said top portion including a plurality of spaced openings constructed and arranged to receive said prominences of said rear wall of said receiver there through to intermesh said attachment mount with said receiver.

13. The attachment mount and receiver system as defined in claim 12, wherein said resistance means include:

a foot portion located generally medially of a bottom portion of said central part of said base member; and a complemental socket for said foot portion located generally medially of said bottom portion of said inner surface of said rear wall of said receiver and projecting outwardly from said inner surface, said socket being aligned with said foot portion and nestingly maintaining said foot portion therein when said attachment mount is fully seated in said receiver.

14. The attachment mount and receiver system as defined in claim 11, wherein said resistance means include:

a foot portion located generally medially of a bottom portion of said central part of said base member and laterally spaced from each said partial front end wall; and a complemental socket for said foot portion located generally medially of said bottom portion of said inner surface of said rear wall of said receiver and projecting outwardly from said inner surface, said socket being aligned with said foot portion and nestingly maintaining said foot portion therein when said attachment mount is fully seated in said receiver.

15. The attachment mount and receiver system as defined in claim 13, further comprising tine blocking, means for removably inhibiting inward compression of said tines of said attachment mount when said attachment mount is fully seated within said receiver.

16. The attachment mount and receiver system as defined in claim 1, further comprising movable tine blocking means cooperating between said tines and said receiver for inhibiting inward compression of said tines of said attachment mount when said attachment mount is fully seated within said receiver.

17. The attachment mount and receiver system as defined in claim 16, further comprising prying resistance means for inhibiting prying of said attachment mount outwardly toward said front walls and away from said receiver.

18. An attachment mount and receiver system for removably attaching articles to a garment comprising:

a receiver with a pocket for receiving an attachment mount, said pocket being bounded by a pair of opposing end walls, a pair of spaced partial front walls extending substantially perpendicularly between said end walls with each said front wall having an end formed integrally with a respective said end wall, a rear wall generally coplanar with said front walls and extending perpendicularly between said end walls, said rear wall having opposing ends with each said end being formed integrally with a respective said end wall;

said rear wall of said receiver having a top portion, an inner surface, a bottom portion, a plurality of spaced openings extending through said rear wall for affixing a support thereto, and at least one radial spline connection having an attaching hole extending through said rear wall surrounded by spline connection for affixing said receiver to a complemental spline on a support allowing for said receiver to be affixed at a plurality of angles relative to such support;

said receiver having a complemental socket located generally medially of said bottom portion of said inner surface of said rear wall of said receiver and projecting outwardly from said inner surface;

said attachment mount having a pair of opposing side edges and a substantially planar base member; said base member containing a front surface, a substantially vertical central part located generally medially of said base member, and a foot portion located generally medially of a bottom portion of said central part to be received within said complemental socket of said receiver, said central part including a raised elongated mounting portion formed integrally with said front surface and projecting outwardly and being substantially parallel to said front surface of said base member, said mounting portion including attaching means for securing an article to said attachment mount;

said attachment mount including a pair of spaced tines resiliency compressible toward each other, each said tine being adjacent respective said side edges of said attachment mount and each with a tapered lower extremity and a barb for engaging a lower end of each said end wall of said receiver; and said rear wall of said receiver including a plurality of spaced prominences extending generally vertically from said top end of said rear wall; and said attachment mount including a top portion opposing said foot portion of said base member, said top portion including a plurality of spaced openings constructed and arranged to receive and capture said prominences of said rear wall therethrough to intermesh said attachment mount with said receiver.

19. An attachment mount and receiver system for removably attaching articles to a garment, comprising:

a receiver with a pocket for receiving an attachment mount, said pocket being bounded by a pair of opposing end walls, a pair of spaced partial front walls extending substantially perpendicularly between said end walls with each said front wall having an end formed integrally with a respective said end wall, a rear wall generally coplanar with said front walls and extending perpendicularly between said end walls, said rear wall having opposing ends with each said end being formed integrally with a respective said end wall;

said rear wall of said receiver having a top portion, an inner surface, a bottom portion, a plurality of spaced openings extending through said rear wall for affixing a support thereto;

said receiver having a complemental socket located generally medially of said bottom portion of said inner surface of said rear wall of said receiver and projecting outwardly from said inner surface;

said attachment mount having a pair of opposing side edges and a substantially planar base member; said base member containing a front surface, a substantially vertical central part located generally medially of said base member, and a foot portion located generally medially of a bottom portion of said central part to be received within said complemental socket of said receiver, said central part including a raised elongated mounting portion formed integrally with said front surface and projecting outwardly and being substantially parallel to said front surface of said base member, said mounting portion including attaching means for securing an article to said attachment mount and;

said attachment mount including a pair of spaced tines resiliency compressible toward each other and a pair of spaced springs, each said tine being adjacent respective said side edges of said attachment mount and each with a tapered lower extremity and a barb for engaging a lower end of each said end wall of said receiver, each said spring having a pair of opposing ends being located between a respective said tine and said central part of said base member of said attachment mount for permitting compression of said tines toward each other, said springs being uncompressed when said barbs respectively engage said lower ends of said end walls of said receiver, a first said end of each said spring being formed integrally with a proximate side of said central part and a second said end formed integrally with a proximate side of a respective said tine, said tines and said springs selectively removably secure said attachment mount to said receiver.

20. The attachment mount and receiver system as defined in claim 19, wherein said receiver further includes a pair of spaced levers each pivotally attached to said bottom portion of said inner surface of said rear wall of said receiver between said end walls of said receiver, such that each said lever removably inhibits inward compression of a respective proximate said tine of said attachment mount when said attachment mount is fully seated within said receiver.

21. The attachment mount and receiver system as defined in claim 19, wherein said receiver further includes an elongated bar having opposing ends extending outwardly toward said front walls of said receiver, said bar slidingly attached to said bottom portion of said inner surface of said rear wall of said receiver between said end walls of said receiver, such that said ends of said bar removably inhibit inward compression of said tines of said attachment mount when said attachment mount is fully seated within said receiver.

22. The attachment mount and receiver as defined in claim 1 wherein said central part mounting portion is vertically elongated, said openings extending through said mounting portion including spaced generally vertically arcuate slots and at least one horizontally elongated arcuate slot spaced above a lower end of said central part.

* * * * *